US005465915A

United States Patent [19]

Ahlen et al.

[11] Patent Number: 5,465,915

[45] Date of Patent: Nov. 14, 1995

[54] APPARATUS FOR DIVIDING A FLOW OF FIBROUS MATERIAL INTO AT LEAST TWO EQUALLY METERED FLOWS

[75] Inventors: Arne Ahlen, Roswell; Anders Mokvist, Snellville, both of Ga.; Thor Johansen, Prior Lake, Minn.

[73] Assignee: Sunds Defibrator Industries Aktiebolag, Sweden

[21] Appl. No.: 256,749

[22] PCT Filed: Nov. 23, 1992

[86] PCT No.: PCT/SE92/00801

§ 371 Date: Jul. 19, 1994

§ 102(e) Date: Jul. 19, 1994

[87] PCT Pub. No.: WO93/11295

PCT Pub. Date: Jun. 10, 1993

[30] Foreign Application Priority Data

Nov. 25, 1991 [CA] Canada ..... 2-056092

[51] Int. Cl.[6] ..... B02C 23/02

[52] U.S. Cl. ..... 241/247; 241/261.2; 162/261

[58] Field of Search ..... 162/261, 23, 63; 241/244, 245, 261.2, 261.2, 253, 246, 247, 248, 260.1, 227, 222, 223; 209/913

[56] References Cited

U.S. PATENT DOCUMENTS

| | | | |
|---|---|---|---|
| 4,223,847 | 9/1980 | Tantalo et al. | 241/247 |
| 4,457,804 | 7/1984 | Reinhall | 162/254 |
| 4,600,475 | 7/1986 | Reinhall et al. | 162/261 |
| 4,878,997 | 11/1989 | Reinhall | 162/23 |

FOREIGN PATENT DOCUMENTS 2533878 10/1976 Germany .

*Primary Examiner*—David L. Lacey
*Assistant Examiner*—Calvin Padgett
*Attorney, Agent, or Firm*—Lerner, David, Littenberg, Krumholz & Mentlik

[57] ABSTRACT

Apparatus for controlling the flow of fibrous material is disclosed including a substantially horizontal feeder press, a rapidly rotatable spreader screw disposed in a vertical housing, with the outlet end of the feeder press connected to the vertical housing, at least two metering screws disposed below the outlet end of the vertical housing, and a spreader disk disposed at the outlet end of the vertical housing for disintegrating the fibrous material and distributing it to the metering housing containing the metering screws.

9 Claims, 2 Drawing Sheets

APPARATUS FOR DIVIDING A FLOW OF FIBROUS MATERIAL INTO AT LEAST TWO EQUALLY METERED FLOWS

FIELD OF THE INVENTION

The present invention relates to the field of precisely dividing a flow of fibrous material into two or more equally measured flows.

BACKGROUND OF THE INVENTION

In many industrial applications it is necessary to divide a flow of materials into a number of equal, smaller flows. This is normally accomplished by utilizing volumetric metering screws. However, this method becomes useless when, because of various process requirements, the material is first processed and dewatered through a screw press or a plug feeder. Material passing through this equipment will drastically alter its density. That will result in uneven density, which volumetric metering screws cannot properly handle. Such operation is nowhere more important than in the refining of woodchips or other cellulosic material in a twin flow refiner, i.e. a refiner having one rotating rotor element between two stationary elements, thereby forming two grinding zones.

A twin flow refiner relies entirely on the mat of fibrous material being fed to each side of the rotating rotor element, where the grinding zones are contained. It is imperative to maintain the gaps of the two grinding zones within one-half thousandth of an inch, otherwise an inferior fiber quality will be produced. Although each stationary element forming a side of the gap of the grinding zones is individually controlled by a servo mechanism, the rotating rotor position is entirely dependent on the nature of the fibrous mat which is maintained continuously in the two grinding zones. Uneven flow of each zone will result in disastrous fiber quality problems.

The present invention concerns a device that will restore the homogeneous density of the wood chips and fibrous material after being processed and dewatered through the screw press or plug feeder and at the same time spread the material evenly into two or more metering screws. It has been found that this device provides improvement in fiber quality with superior paper tensile strength.

SUMMARY OF THE INVENTION

It is the object of the present invention to provide a disintegrating zone to obtain an even density of the incoming material flow and spread the material evenly into the metering screws.

In accordance with the present invention, this and other objects have now been accomplished by the invention of apparatus for controlling the flow of fibrous material. The apparatus comprises a substantially horizontal feeder press including an inlet and an outlet end for feeding a plug of fibrous material therebetween, a vertical housing having a lower outlet end, at least one rapidly rotatable spreader screw disposed in the vertical housing, the outlet end of the feeder press connected to the vertical housing, a metering housing, at least two metering screws disposed in the metering housing, the metering screws being disposed below the outlet end of the vertical housing, and spreader disk means disposed at the outlet end of the vertical housing for disintegrating the fibrous material and distributing the disintegrated fibrous material to the metering housing containing the metering screws.

In accordance with one embodiment of the apparatus of the present invention, one rapidly rotatable spreader screw is utilized. In another embodiment, the at least one rotatable spreader screw comprises first and second threads, and preferably the spreader disk means comprises a plurality of vanes, most preferably comprising direct extensions of the first and second threads.

In accordance with another embodiment of the apparatus of the present invention, the at least one rapidly rotatable spreader screw comprises at least one thread comprising a flank portion, and including teeth thereon.

In accordance with another embodiment of the apparatus of the present invention, the at least one rapidly rotatable spreader screw comprises first and second rapidly rotatable spreader screws. The apparatus preferably includes steam disk means cooperating with the outlet end of the feeder press for preventing steam from flowing from the vertical housing into the outlet end of the feeder press. In another embodiment, the at least one rapidly rotatable spreader screw is cantilevered within the vertical housing, and the apparatus includes an expanded extension of the vertical housing disposed below the outlet end of the vertical housing.

In accordance with one aspect of the present invention, there is provided a spreader screw, for breaking up or disintegrating an incoming continuously formed plug of material into individual chips or defibrated fibers.

At the end of the screw an impeller type disk is provided for even distribution of the material around the inside wall of an expanded cylindrical chamber. The material then falls by gravity evenly into the metering screws.

Although the total gap of the two grinding zones in a twin flow refiner can be controlled, the individual gap is entirely controlled by the thickness of the fibrous material being fed into the zones from each side. In order to maintain a constant gap in the zone, it is necessary to feed both sides of the rotor with an equal flow of material. Otherwise the rotor will float back and forth and disturb the pulp makers criteria of "Constant Gap Control," which is very important in making mechanical pulp in refiners. Otherwise the pulp quality cannot be controlled.

BRIEF DESCRIPTION OF THE DRAWINGS

The present invention may be more fully understood by reference to the following detailed description, which refers to the Drawings, in which.

DETAILED DESCRIPTION

Figure 1:
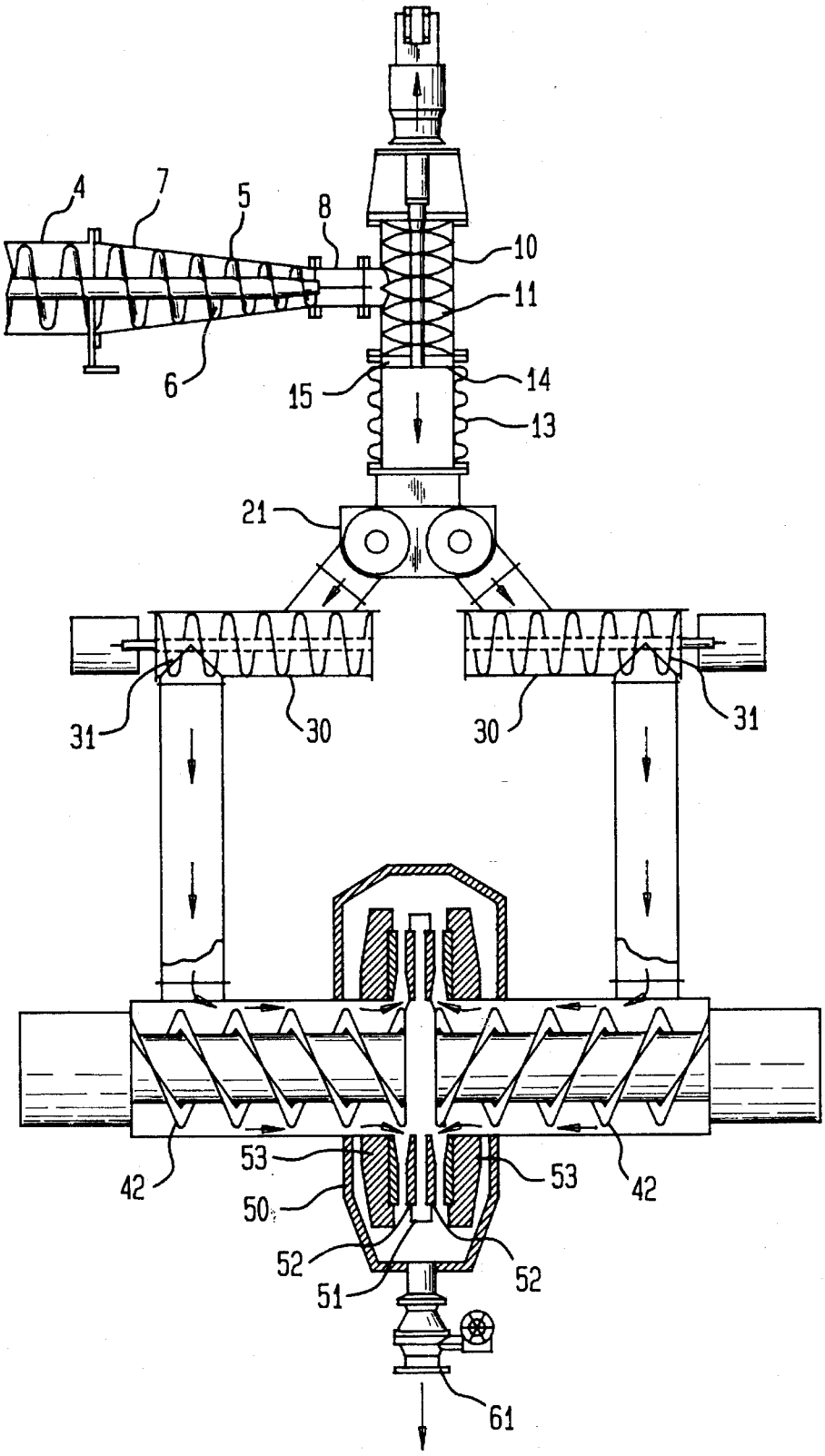
FIG. 1 is a top, elevational, cross-sectional view of a preferred embodiment of the apparatus of the present invention.
Figure 2:
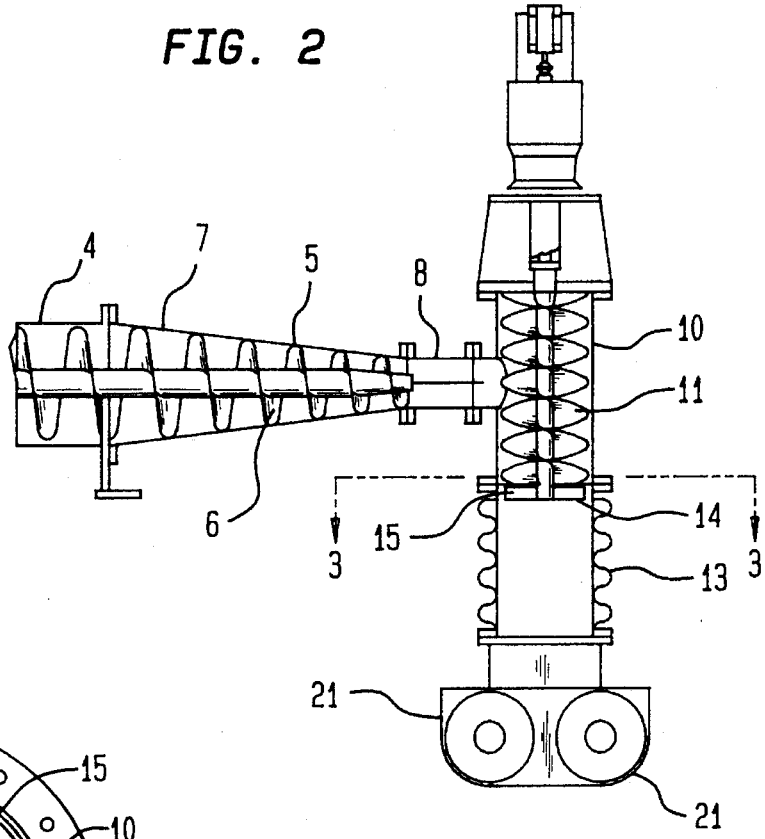
FIG. 2 is a top, elevational, cross-sectional view of a spreader screw and disk together with a volumetric divider screw in accordance with a preferred embodiment of the apparatus of the present invention.
Figure 3:
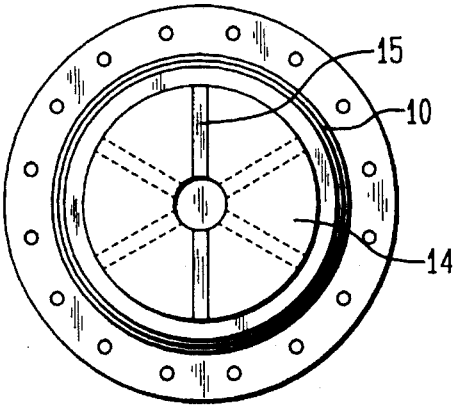
FIG. 3 is a top cross-sectional view of the preferred embodiment of the spreader disk shown in FIG. 2, taken along line A—A.

The drawings show a plug feeder press 7 including an inlet section 4, a throat section 5, a plug pipe outlet 8 and a screw 6. The plug pipe outlet 8 is directly connected to a vertical spreader screw housing 10 with a vertical cantilevered spreader screw 11. The bottom of the housing 10 is in direct communication with an inlet housing 13 of a twin metering screw 21, the inlet housing 13 being generally cylindrical and preferably of larger diameter than the spreader screw housing 10.

In the lower end of the spreader screw 11 a spreader disk 14 is mounted. The spreader disk 14 is provided with at least two radial vanes 15. Preferably, each vane 15 is a direct extension of each screw thread, and the spreader screw 11 preferably comprises two threads. As an alternative, the vanes may be separated from the screw threads and there may be more than two vanes. The spreader screw 11 with its spreader disk 14 should preferably extend into the inlet housing 13. The spreader screw housing 10 may be pressurized, non-pressurized or under vacuum.

According to a preferred embodiment, the spreader screw housing 10 is arranged so that it is substantially perpendicular to the plug pipe outlet 8. In this manner, the incoming flow of compressed material in the form of a continuous plug feed is disintegrated by the threads of the spreader screw 11 which is rotating at high speed, e.g. about 200–1800 RPM. These threads can also be provided with teeth on their flanks in order to further improve the disintegrating action.

The fibrous material which is disintegrated by means of the spreader screw 11 will obtain a very uniform density. The material is conveyed downward by the rapidly rotating spreader screw 11. At the lower end of the screw 11 the material hits the spreader disk 14 and its vanes 15. In this manner, the material is thrown outwardly to the inside wall of the inlet housing 13 of the twin metering screw 21, and the material then falls by gravity evenly into the twin metering screw 21.

In this embodiment each metering screw meters the material into a transfer housing 30 with a transfer screw 31. These screws 31 convey the material into refiner feed screws 42 by means of which the material enters the grinding zones of a twin flow refiner. These zones are defined by the gaps 52 between a rotating grinding disk 51 and two stationary grinding disks 53, one at each side of the rotating disk 51. In each grinding zone the material forms a fibrous mat, the thickness of which corresponds to each grinding gap 52.

The grinding disks 51, 52 are surrounded by a refiner housing 50 so that the refined material, which leaves the grinding zones, enters the refiner housing 50. Finally, the refined material is blown out of the housing 50 through a blow valve 61.

Figure 4:
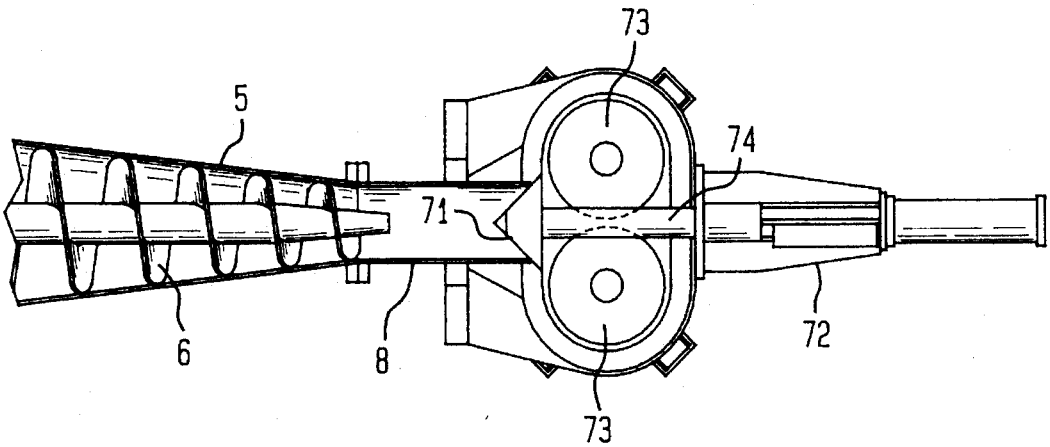
FIG. 4 is a side, elevational, cross-sectional view of a spreader screw in accordance with another embodiment of the present invention.

In the alternative design shown in FIG. 4 there are two vertical spreader screws 73. This design makes it possible to install a back blow control system which will prevent steam from flowing back through the plug pipe 8 when the screw spreader housing 10 is pressurized. The back blow control system comprises a disk means 71 mounted on a shaft 74 which is movable by means of a cylinder 72. As shown in FIG. 4 the shaft 74 extends between the two spreader screws 73 and the disk means 71 cooperates with the plug pipe outlet 8.

However, in most cases the material plug in the plug pipe 8 is so compressed that it will prevent steam from flowing backward through the plug pipe. Therefore, the embodiment of FIG. 1 can be used in connection with a pressurized spreader housing.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. Apparatus for controlling the flow of fibrous material comprising a substantially horizontal feeder press including an inlet end and an outlet end for feeding a plug of said fibrous material therebetween, a vertical housing having a lower outlet end, at least one rotatable spreader screw disposed in said vertical housing, said outlet end of said feeder press connected to said vertical housing so that the plug contacts said spreader screw, a metering housing having an inlet end in flow communication with said outlet end of said vertical housing and an outlet end, at least two metering screws disposed in said metering housing, said metering screws being disposed below said outlet end of said vertical housing, and spreader disk means disposed at said outlet end of said vertical housing for disintegrating said fibrous material and distributing said disintegrated fibrous material to said metering housing containing said metering screws.

2. The apparatus of claim 1 wherein said at least one rotatable spreader screw comprises a single rotatable spreader screw.

3. The apparatus of claim 1 wherein said at least one rotatable spreader screw comprises first and second threads.

4. The apparatus of claim 3 wherein said spreader disk means comprises a plurality of vanes.

5. The apparatus of claim 4 wherein said plurality of vanes comprise direct extensions of said first and second threads.

6. The apparatus of claim 1 wherein said at least one rotatable spreader screw includes at least one thread comprising a flank portion, and including teeth on said flank portion.

7. The apparatus of claim 1 wherein said at least one rotatable spreader screw comprises first and second rotatable spreader screws.

8. The apparatus of claim 7 including steam disk means cooperating with said outlet end of said feeder press for preventing steam from flowing from said vertical housing into said outlet end of said feeder press.

9. The apparatus of claim 1 wherein said at least one rotatable spreader screw is cantilevered within said vertical housing, and wherein said spreader screw extends into an inlet end of said metering housing.

* * * * *